United States Patent [19]

Rehag et al.

[11] Patent Number: 4,577,483

[45] Date of Patent: Mar. 25, 1986

[54] SYSTEM FOR THE CONTINUOUS OPERATION OF A COLD PILGER ROLLING MILL

[75] Inventors: Klaus Rehag, Monchen-Gladbach; Josef Gerretz, Viersen, both of Fed. Rep. of Germany

[73] Assignee: Mannesmann Demag Wean, Pittsburgh, Pa.

[21] Appl. No.: 575,607

[22] Filed: Jan. 31, 1984

[30] Foreign Application Priority Data

Feb. 2, 1983 [DE] Fed. Rep. of Germany ..... 3304002

[51] Int. Cl.[4] ..... B21B 21/04

[52] U.S. Cl. ..... 72/214; 72/252; 74/27; 74/89.15; 226/112

[58] Field of Search ..... 72/214, 252, 250; 226/112; 74/27, 840, 89.15

[56] References Cited

U.S. PATENT DOCUMENTS 3,030,835 4/1962 Krause ..... 72/214 X
4,019,394 4/1977 Peytavin ..... 74/27
4,154,079 5/1979 Peytavin ..... 72/214
4,184,352 1/1980 Potapov et al. ..... 72/252 X

*Primary Examiner*—Francis S. Husar
*Assistant Examiner*—Steven B. Katz
*Attorney, Agent, or Firm*—Daniel Patch; Suzanne Kikel

[57] ABSTRACT

A spur gear assembly for axially mounting and supporting an end of a feed screw for each carriage and is driven from the main drive, since these feed screws of each carriage are arranged coaxially along a line parallel to a passline of the pilger mill. This spur gear allows relative rotation of the feed screws in this gear assembly mounting and a similar mounting is provided for the other screws of the pair of screws for each carriage. A first gear unit connected to the main drive causes a reciprocation of the stand along with the two feed carriages, and a second gear unit including a shaft clutch assembly is selectively brought into engagement and disengagement with the spur gear assemblies and the first gear unit to impart rotation to the screws to separately and independently advance and return the feed carriages to their starting position while one of the feed carriages continues to advance the shell through the mill.

10 Claims, 3 Drawing Figures

SYSTEM FOR THE CONTINUOUS OPERATION OF A COLD PILGER ROLLING MILL

The invention relates to a continuously operated cold pilger rolling mill for producing tubes from a shell, and comprises a reciprocating stand, a main drive for the reciprocating stand, and two feed carriages each equipped with chucks or collets, which carriages are located in the feed bed one behind the other in the direction of rolling and are traversible in this direction by feed screws which are usually connected to the main drive. In addition, an oscillating axial movement is imparted to the feed screws over a system of gears, levers, etc. which are also driven through the main drive.

In German Pat. No. 27 25 276, a continuous cold pilger rolling mill of the general type has become known, which can be used in a discontinuous operation as well. In the case of continuous operation, both feed carriages advance the bloom or shell together for a short period of time before one feed carriage, reaching its end position, is quickly moved back. In this known rolling mill, one feed screw or spindle is provided for each feed carriage or slide. The way in which this mill functions requires practically two complete feed gear systems, thereby complicating the apparatus.

Another continuously operated cold pilger rolling mill has become known as a result of German Patent Specification No. 24 24 907, wherein each feed carriage is driven by only one spindle or screw. It has been shown that a disadvantage of this design is that during the rolling cycle there is a period of time in which the quality of rolling of the shell is impaired and causes wear on the moving parts. Since the spindles are rigidly attached to the feed carriage, a back thrust on the shell imparted by the roll dies is transferred into the gearing system, which, as already mentioned wear out and are extremely expensive to replace.

German Pat. No. 24 49 862 discloses an essentially simplified feed drive for two feed carriages. Here separate driving systems are provided for each set of slides each having two counter-rotating feed screws. When one feed carriage is to be returned to its starting position, it is necessary to stop the advance of the bloom for the time it takes for the feed to be transferred from one feed carriage to the other.

In view of the above described inadequacies and disadvantages of these known continuous cold pilger rolling mills, a basic objective of the present invention, based on the state of the art corresponding to German Pat. No. 21 16 604, is to improve the typical continuously operated rolling mill in such a way the feed forces are smoothly transferred from one feed carriage to the other in their advancement of the shell through the mill without stopping the mill so that the quality of the rolling is improved by modifying these well-known pilger mill designs by adding simple structural features so that a pilger rolling mill is created which can be used effectively, particularly for the short shells or blooms.

A further object of the subject invention is to provide in a continuous cold rolling pilger mill having a reciprocating roll stand with repetitive cyclic periods of operation, an improved feed system arranged on the entry side of said mill for continuously feeding a shell along a passline of said mill between rolls in said roll stand to be reduced therebetween, comprising feed carriage means positioned along said passline for displacement towards and away from said stand respectively corresponding to a shell feed starting position and a shell feed finishing position, said feed carriage means including first and second tandemly arranged feed carriages having chucks engageable with said shell for said advancement of said shell through said mill in said shell feed starting position of each carriage, feed screw means mounted in each of said feed carriages for effecting said displacement of said feed carriages relative to said stand, first drive means driven in a timed relationship to said mill reciprocation and connectable to said each feed screw means to reciprocate said feed carriages together as a unit with said reciprocation of said rolling stand, and second drive means, including a gear unit associated with said feed screw means and shaft-clutch assembly means constructed and arranged in a manner to selectively engage and disengage said gear unit so that superimposed on said reciprocation of said each feed carriages, rotation is imparted to said feed screws to move said feed carriages separately and independently relative to each other for their individual said displacement towards and away from said stand.

A cold pilger rolling mill designed according to the teachings of the subject invention which includes two aligned feed screws for the feeding of the shell eliminates the introduction of damaging forces in the feed slide and it provides for a continuous advancing of the bloom through the mill whereby a turning off of the feeding is no longer necessary. A direct axial mounting for the parallel feed spindles of the parallel slides, which mounting includes a means for permitting relative rotation between the two axially arranged spindles, one of each carriage, enables a continuous motion of the feed slides involving a return of one slide to its starting position immediately upon its arrival in its end position while the other slide begins to advance the shell. With the omission of a complete complicated second feed gearing system as that which is required in the arrangement disclosed in the above-mentioned German Pat. No. 27 25 276, there is a very simple and relatively inexpensive construction in the proposed arrangement of the subject invention to the extent that such a rolling mill arrangement can be used economically to roll short shells. The damaging moment on the portion of the shell being rolled and on the gearing during the rolling cycle does not occur, since each feed carriage is moved by two parallel feed spindles similarly to that disclosed in the above-mentioned German Pat. No. 24 49 862.

According to a further object of the subject invention, there is provided at least one drive shaft assembly arranged parallel to the feed screws and connected to the main gearing arrangement and equipped with clutch assemblies whereby either one of the two feed carriages can selectively be switched in for its advancement or return. This provision for a parallel drive shaft assembly with shifting couplings or clutches enables the separate driving of one feed screw pair as well as the other feed screw pair so that each feed carriage moves independently of the other, and consequently a continuous advancement of the shell, and thus, a continuous operation of the rolling mill.

And yet still a further object of the subject invention is to provide a drive shaft assembly for transferring the torque of the drive to the pair of feed screws of the feed carriage nearer the roll stand through a special support mounting assembly which connects a feed screw of one feed screw pair to a corresponding coaxial feed screw of the other feed screw pair, i.e. a drive shaft arranged parallel to the feed screws is made to be extended or lengthened through engagement of a clutch assembly so that the pair of feed screws of the feed carriage located closest to the roll stand receives the torque through a simple spur gear arrangement.

In order to decrease the expense and the structural length of the cold pilger rolling mill, the subject invention further provides that the special support mounting means be provided between each feed screw of one carriage coaxially arranged with corresponding ones of the other carriage for axially supporting the screws, and which mounting means contains a rotary drive assembly for allowing rotation of one screw relative to the other, which two feed screws are housed in the same mounting assembly to fixedly mount an end of the feed screw of the feed screw pair driving the feed carriage nearer the roll stand, and to receive a corresponding end of the feed screw of the other feed screw spindle pair, wherein sperical thrust bearings are provided between the spur gear portion and the end of the feed screw of this other feed screw pair. This special mounting apparatus for each corresponding end of the parallel feed screws for the different feed carriages in addition to allowing relative rotation therebetween allows the parallel feed screws to be misaligned axially yet be fixed to the extent both feed screws move in an axial direction as a unit.

These objects, as well as other novel features and advantages of the present invention, will be better understood and appreciated when the following description thereof is read along with the accompanying drawings of which:

The principles and operation of a cold pilger rolling mill for working a hollow workpiece are well-known in the industry and can be found in several issued patents in the art, particularly U.S. Pat. Nos. 3,344,644 and 4,037,444 and therefore will not be discussed herein.

Figure 1:
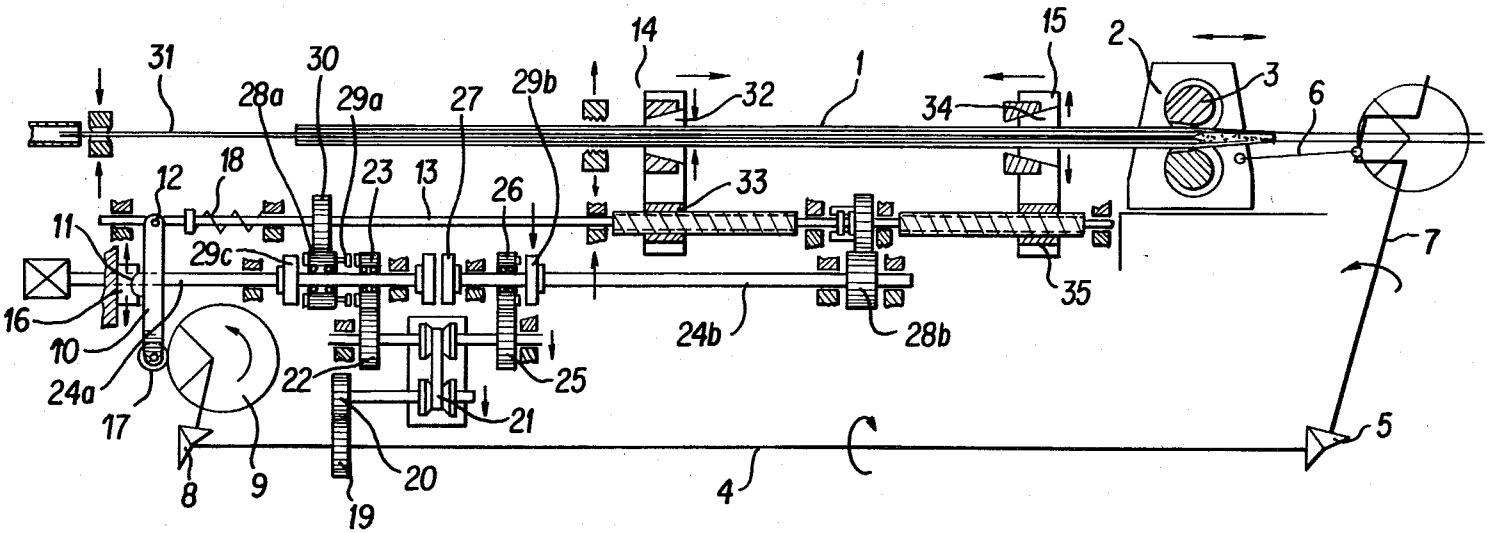
FIG. 1 is a schematic view of a preferred embodiment for a continuously operated cold pilger rolling mill according to the teachings of the subject invention.

In FIG. 1, the rolled stock or shell 1 which as is known, is fed forward to the right of FIG. 1 along a passline of the mill to advance a segment of shell to be worked. This is done at the same time as the rolls 3 mounted in roll stand 2 release shell 1 during a rolling cycle. The drive for the feeding apparatus shown to the left in FIG. 1 is done through main drive shaft 4, over bevel gearing 5 of crankshaft 7, which causes through drive rod 6 the reciprocation of roll stand 2.

Drive shaft 4 through a pair of bevel gears 8 rotate cam plate 9 mounted in a reduction gear box. This cam plate 9 imparts it motion to a two-legged lever 10, which has its center of rotation at 11, and whose rotation is directly dependent upon the position of the crank of crankshaft 7. This pivotal motion of lever 10 translates its effect at point 12 as a translational movement to feed spindle assembly 13 mounted in suitable bearings for rotation and axial displacement to the left and right in FIG. 1.

In order to vary the magnitude of this translational movement at point 12, and consequently the magnitude of the advancement of shell 1 by either feed slide, or carriage 14 or 15, the center of rotation 11 of the lever 10 is located in a slide ring 16 where the lengths of each leg of lever 10 can be varied. In the preferred embodiment shown, spring 18 provides the required tensioning against lever 10 to always retain roller 17 in contact with the surface of cam plate 9.

For the translational movement of feed spindle assembly 13 at point 12 for each rotation of cam plate 9 over a certain angle of its rotation, which is referred to as the operating angle, a constant rotation of the feed screws of both feed carriages 14 and 15 can be selectively superimposed. This is accomplished by a gear 19 mounted on drive shaft 4, which gear 19 meshes with gear 20, which, in turn, translates its rotation to an infinitely adjustable gear 21, from which point torque is distributed to spur gear stages 22, 23 or 25, 26. Spur gears 23 and 26 are mounted on a two-piece drive shaft assembly 24 consisting of shafts **24*a* and 24*b*, which shafts are brought together as a unit or separated through a two piece clutch assembly 27 located between spur gears 23 and 26. Spur gear 23 is placed into a gear train consisting of spur gears 28*a*, 30 and 36 to drive feed slide 14 by a clutch assembly 29*a*, and similarly, gear 26 is placed into a gear train consisting of spur gears 28*b*, 37 and 40 to drive the other feed slide 15 by a clutch assembly or coupling 29*b*. As can clearly be seen in FIG. 1, spur gears 23, 26, and 28*a* consists of roller bearings to allow relative rotation between shafts 24*a* and 24*b* of drive shaft assembly 24 and these three gears. When clutch assemblies 29*a* and 29*b* are engaged with spur gears 23 and 26 respectively, both feed carriages 14 and 15 are driven simultaneously. By way of carriage return motor 29, shaft 24*a* or 24*b* of drive shaft assembly 24 can be rapidly driven in a reverse direction in order to return either one or the other feed slides 14 and 15. A gearing-clutch assembly not shown herein can be provided as well, for example, between gears 22 and 23 or 25 and 26, wherein the drive for the return of the feed carriages 14, 15 can be supplied through main drive shaft 4**.

Figure 2:
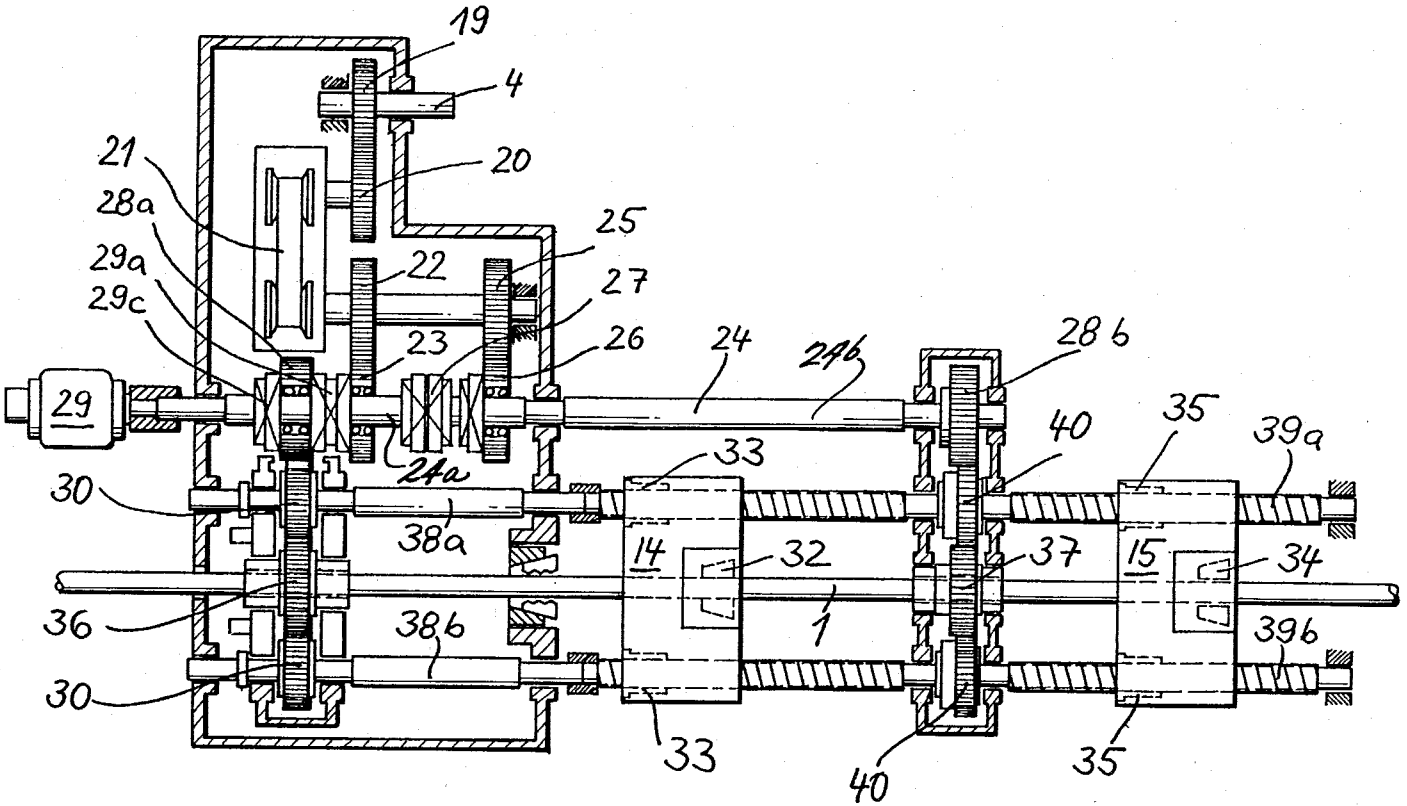
FIG. 2 is a top view of a feeding gear system shown in FIG. 1.
Figure 3:
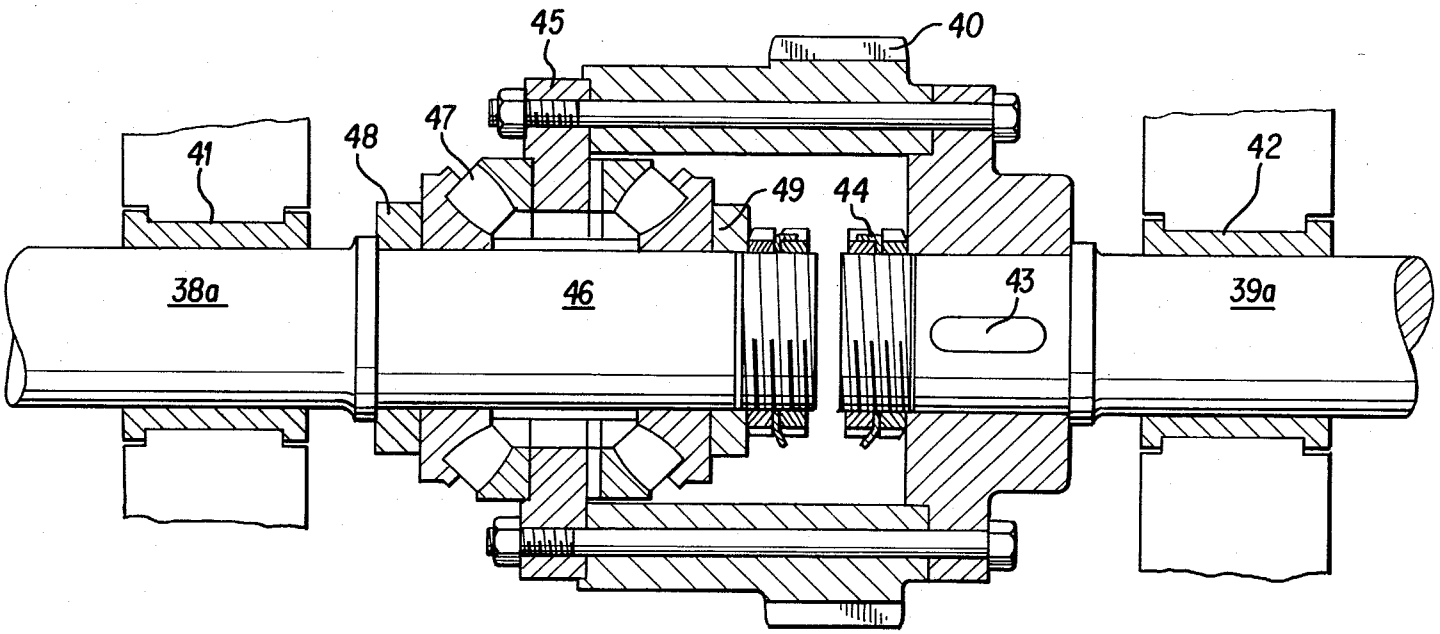
FIG. 3 is an enlarged view illustrating a mounting apparatus shown in FIGS. 1 and 2 for the axial support of the cooperating parallel feed screws for the different feed carriages.

In FIGS. 2 and 3, equivalent parts are given the same numbers as FIG. 1. As can be seen in FIG. 2, a pair of threaded spindles or screws is provided for each feed carriage 14, 15; that is feed screws **38*a*, 38*b* for feed carriage 14, and feed screws 39*a*, 39*b* for feed carriage 15. The drive for spindle 38*a* is done by drive shaft 24*a* of shaft assembly 24 over spur gear 30 and is transferred to the other feed spindle 38*b* of the spindle pair for feed carriage 14 over an intermediate gear 36 to a second spur gear 30, so that both spindles 38*a*, 38*b*** are rotated in the same direction.

Nuts 33 are located on opposite sides of an axis of the shell and feed carriage 14 to receive feed screws **38*a*, 38*b*. These nuts 33 have the same pitch and feed carriage 14 travels evenly without cocking over screws 38*a* 39*b*** in the direction of rolling.

The drive of feed slide 15 is similarly done through drive shaft **24*b* of shaft assembly 24 over gear 28*b* to spur gear 37 and spur gear assemblies 40. Each spur gear assembly 40 is fixedly mounted to the end of feed screws 39*a*, 39*b* of the pair of screws provided to impart motion to feed carriage 15, wherein torque is distributed to both screws 39*a* and 39*b* by intermediate spur gear 37. Depending on the direction of rotation of drive shaft 24*b*, feed screws 39*a* and 39*b* rotate in the same direction to move feed carriage 15 towards or away from roll stand 2. Screws 39*a*, 39*b* are received in nuts 35 whose thread have the same pitch to smoothly and evenly glide carriage 15** without a cocking effect.

In FIG. 3, an axial mounting assembly for supporting feed screws 38*a*, 39*a* of carriages 14, 15 respectively in gear assembly 40 is illustrated. In a similar fashion, but not shown herein, feed screws 38*b* and 39*b* of carriages 14, 15 respectively, are connected to each other in the lower gear assembly 40 shown in FIG. 2. These feed screws 38*a* and 39*a* in FIG. 3 are rotatably mounted in bearings 41, 42 respectively, which bearings are in turn mounted to the feed bed. A collar on the end of feed screw 39*a* is provided to receive and fixedly mount by a key mounting 43 screw 39*a* in gear assembly 40, which screw 39*a* is held against axial movement by nuts 44. A second collar member 45 is located to the left in FIG. 3 for receiving end 46 of feed screw 38*a*.

Mounted onto end 46 of feed screw 38*a* and collar member 45 is a roller bearing assembly consisting of taper thrust bearings 47, which bearing assembly is fixed axially by members 48 and 49, but permits feed spindle 38*a* to rotate freely with respect to the spur gear of gear assembly 40.

A description of the operation of a continuous cold pilger rolling mill incorporating the teachings of the subject invention is as follows. Carriages 14 and 15 are in their starting position to the left of each carriage in FIG. 1. Shell 1 is clamped in collets or chucks 32 in feed carriage 14. Clutch 29*a* is caused to engage spur gear 23 thereby moving intermittently carriage 14 to the right towards stand 2. At this time, feed carriage 15 remains in its starting position with clamping collet 34 opened but is reciprocated with carriage 14 along an axial direction parallel to the mill passline, which oscillation is imparted through cam plate 9 and lever 10 at point 12.

Before carriage 14 reaches its final position to the right in FIG. 1, feed carriage 15 is set into translational motion by engaging clutch 29*b* to spur gear 26 so that both carriages 14 and 15 move forward intermittently. Shell 1 is then clamped into collet 34 of feed carriage 15, and is freed from feed carriage 14 by opening collet 32, at which time clutch 29*a* is disengaged from spur gear 23. Clutch 29*c* is caused to engage spur gear 28*a* for the rapid return of carriage 14 where motor 29 reverses the rotation of screws 38*a* and 38*b*. When carriage 14 has returned to its starting position clutch 29*c* is disengaged from gear 28*a*. Even before carriage 15 reaches its final position, clutch 29*a* is switched in again to engage gear 23. Shell 1 is again clamped in carriage 14, which consequently takes over the feeding of shell 1 when carriage 15 frees shell 1. Clutch 29*b* is disengaged from gear 26 and clutch assembly 27 is switched in so that the two disjunct shafts 24*a* and 24*b* of drive shaft assembly 24 are brought together as shown in FIG. 2 where a reverse rotation is imparted to both shafts 24*a* and 24*b* through motor 29 to quickly return carriage 15 to its starting position to the left in FIGS. 1 and 2. Even though shafts 24*a*, 24*b* are rotating in a direction to return carriage 15, the design of clutch assembly 29*a* and spur gear 23 with its roller bearings allows rotation of gear 22 to be transferred to gears 23, 28*a*, 30 and 36 for the forward movement of carriage 14 towards stand 2.

It is to be understood that shell 1 can be of any length and that more than one shell can be consecutively and continuously fed through the mill for increased productivity.

As particularly shown in FIG. 3, the construction of the special spur gear assembly 40 for axially supporting, and mounting screws 38*a* and 39*a* in the one instance and 38*b*, 39*b* in the other case provides relative rotation between these corresponding parallel screws of the two carriages and provides external teeth to mesh with spur gear 28*b*, 37 to impart its rotation to shaft 39*a*. This gear assembly 40 in conjunction with the design and operation of the clutch gearing arrangement in FIGS. 1 and 2 provide for the continuous and smooth advance of the feed carriages of the pilger mill, i.e. carriage 14 or 15 continuously, without interruption, feeds shell 1 between rolls 3 of rolling stand 2, and accomplishes this in a manner whereby all the disadvantages of prior designs are eliminated.

In accordance with the patent statutes, we have explained the operation and principles of our invention, and have described and illustrated what we consider to be the best embodiment thereof.

We claim:

1. In a cold pilger rolling mill having a reciprocating roll stand with repetitive cyclic periods of operation, an improved feed system arranged on the entry side of said mill for continuously feeding a shell along a passline of said mill between rolls in said roll stand to be reduced therebetween, comprising:

feed carriage means positioned along said passline for displacement towards and away from said stand respectively corresponding to a shell feed starting position and a shell feed finishing position, said feed carriage means including first and second tandemly arranged feed carriages having chucks engageable with said shell for said advancement of said shell through said mill in said shell feed starting position of each carriage, feed screw means mounted in each of said feed carriages for effecting said displacement of said feed carriages relative to said stand and each said feed screw means having an adjacent end arranged in coaxial alignment relative to each other, first drive means driven in a timed relationship to said mill reciprocation and connected to said each feed screw means to impart a translational movement thereto to reciprocate said feed carriages together as a unit with said reciprocation of said rolling stand, and second drive means selectively driven by said first drive means including a gear unit connected to each said feed screw means of said first and second carriages and shaft clutch assembly means selectively engaging and disengaging said each gear unit so that upon said engagement superimposed on said reciprocation of said each feed carriage rotation is imparted to said feed screw means to move said first and second feed carriages separately and independently in unison in the same direction or in opposite directions relative to each other and said stand, and upon said disengagement rotation of said feed screw means is discontinued to maintain said feed carriages separately and independently in a fixed position, said gear unit for said second carriage which is closer to said roll stand than said first feed carriage includes thrust bearing means supporting and mounting said adjacent end of both said feed screw means in said coaxial alignment and effectively located between said two gear units in close proximity to said carriages to offset thrust loads on both said feed screw means and their said respective gear unit caused by said operation of said first and second carriages and said roll stand.

2. In a cold pilger mill according to claim 1, wherein said feed screw means comprises a pair of feed screws for each said first and second carriages, the feed screws of each pair having threads extending in the same direction and being arranged on opposite sides of said passline and the feed screws of one pair being arranged in said coaxial alignment with the feed screws of the other pair to form two sets of axially aligned feed screws, and wherein:

said thrust bearing means are provided for each said set of axially aligned feed screws of said each carriage for said supporting and mounting said feed screws of said one pair in said axial alignment with a feed screw of said other pair, said bearing means further allowing relative rotation between each said axially aligned feed screws of said two sets.

3. In a cold pilger mill according to claim 2, wherein said thrust bearing means further comprises:

a housing fixedly mounting said one feed screw of said axially aligned set, a rotary drive means in said housing rotatably mounting said other corresponding feed screw of said axially aligned set, and a spur gear unit connected to said gear unit of said second drive means imparting said rotation to said fixedly mounted feed screw of said axially aligned feed screw sets.

4. In a cold pilger mill according to claim 3, wherein said rotatably mounted feed screw of said axially aligned sets carries a spur gear unit connected to said gear unit of said second drive means imparting said rotation to said rotatably mounted feed screw of said axially aligned feed screw sets.

5. In a cold pilger mill according to claim 4, wherein said pair of feed screws for said second feed carriage receives said rotation transmitted to said spur gear unit of their respective axial mounting means.

6. In a cold pilger mill according to claims 5 or 1, wherein said shaft-clutch assembly means includes a driving shaft assembly consisting of two disjunct portions arranged axially relative to each other and parallel to said feed screws, a first shaft portion connected to said feed screws of said first carriage and a second shaft portion connected to said second feed carriage, and wherein said gear unit of said second drive means includes at least two spur gears mounted on said first shaft portion and one spur gear mounted on said second shaft portion and are selectively driven by said first drive means through said clutch assembly to rotate said feed screws of said each feed carriages to alternately advance said carriages from their said starting positions towards said roll stand.

7. In a cold pilger mill according to claim 6, wherein said second drive means further comprises an auxilliary power means imparting rotation to said driving shaft assembly, and wherein said clutch assembly consists of a clutch member mounted on the end of each said two shaft portions for engagement and disengagement with each other whereby the rotation from said auxilliary power means is transmitted to either both or only one of said two shaft portions to alternately return said feed carriages from their said finishing positions to their said starting positions.

8. In a cold pilger mill according to claim 7, wherein said clutch assembly further consists of at least one clutch member connectable with each said spur gears of said second gear unit on said two shaft portions, whereby at least one spur gear of said second gear unit on said two different shaft portions is driven by said first drive means, and wherein the appropriate engagement of said clutch members with their said respective spur gears effects said alternate advancing and return of said two feed carriages.

9. In a cold pilger mill according to claim 4, wherein said spur gear unit for said coaxially aligned feed screws is mounted on said feed screws, and wherein said spur gear unit for said coaxially aligned sets consists of a spur gear train rotating said pair of feed screws for said each feed carriage in the same rotational direction.

10. In a cold pilger mill according to claim 3, wherein said rotary drive consists of severally arranged spherical thrust bearings for said rotation of said other corresponding feed screw relative to said fixed axially arranged feed screw in said mounting.

* * * * *